United States Patent [19]

Matsuura

[11] Patent Number: 4,639,120

[45] Date of Patent: Jan. 27, 1987

[54] INDEPENDENT DUAL ELECTROPHOTOGRAPHIC COPYING MACHINE

[75] Inventor: Hirokazu Matsuura, Yamatokoriyama, Japan

[73] Assignee: Sharp Kabushiki Kaisha, Osaka, Japan

[21] Appl. No.: 700,971

[22] Filed: Feb. 12, 1985

[30] Foreign Application Priority Data

Feb. 15, 1984 [JP] Japan ..... 59-27612

[51] Int. Cl.[4] ..... G03G 15/22

[52] U.S. Cl. ..... 355/14 R; 355/3 R; 355/24

[58] Field of Search ..... 355/3 R, 14 R, 24, 25, 355/26

[56] References Cited

U.S. PATENT DOCUMENTS 4,017,173 4/1977 Komori et al. ..... 355/26 X

*Primary Examiner*—Fred L. Braun

[57] ABSTRACT

An electrophotographic copying machine including a copy enabling device, a mode switch, a detection device, and a control device. The mode switch is actuated to select an independent dual copy mode for independently copying two copy documents mounted on two halves of a document table. The detection device is responsive to the mode switch for detecting which copy information relates to either of the two copy documents. The control device is responsive to the detection device for selectively controlling execution of the independent dual copy mode.

7 Claims, 8 Drawing Figures

INDEPENDENT DUAL ELECTROPHOTOGRAPHIC COPYING MACHINE

BACKGROUND OF THE INVENTION

The present invention relates to an electrophotographic copying machine and, more particularly, to an independent dual electrophotographic copying machine.

An electrophotographic copying machine produces an electrostatic latent image on a photoreceptor with an optical system. The latent image corresponds to an image on a copy document such as a manuscript or book to be copied. A developing device is provided so that toner particles are electrically adhered to the latent image, so that the latent image becomes visible as a toner image. The toner image is transferred onto a copy paper via a transference charger.

There is present an improved electrophotographic copying machine of the type which can copy two parts of one-document image onto two individual papers or both sides of one paper, which is referred to as "dual copying machine" herein. In such a machine, conventionally, a first part of document and a second part of document are copied by two different copy cycles. A first and second documents are mounted on a first part and a second part of a document table, respectively, in which a necessary number of copies and the size of the copy paper are selected. Thereafter, the dual copy mode is set, whereby the copy start switch is actuated to start the dual copy operation. Thus, the same number of copied papers are necessarily made. Thus, in the conventional dual copying machine, necessarily, the same number of copied papers in the same size of copied papers are given.

SUMMARY OF THE INVENTION

Accordingly, it is an object of the present invention to provide an improved dual electrophotographic copying machine.

It is another object of the present invention to provide an improved independent dual electrophotographic copying machine for independently conducting a dual copying operation, simultaneously, on different size copy papers.

It is a further object of the present invention to provide an improved independent dual electrophotographic copying machine comprising two different setting means each directed to two sectional faces of a table, so that a dual copying operation is conducted, independently, regarding the two different documents.

Briefly described, in accordance with the present invention, an independent dual electrophotographic copying machine comprises copy enabling means, mode switch means, instruction means, storage means, and control means. The mode switch means is actuated to select an independent dual copy mode for independently copying two copy documents on one or more copy papers. The instruction means is provided for generating different copy instructions regarding the two different copy documents mounted on first and second parts of a table. The storage means is provided for storing the copy instructions from the instruction means, respectively, regarding the two different documents. The control means is responsive to the data from the storage means for selectively responding to either of the copy instructions regarding the two documents to conduct the independent dual copy operation.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENT

Figure 1:
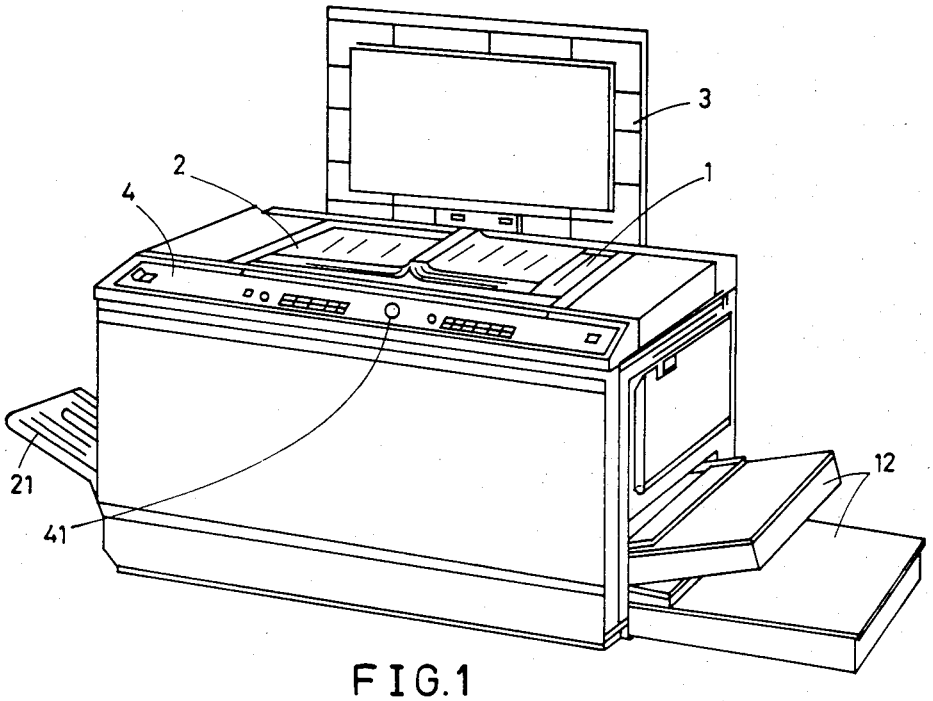
FIG. 1 is a perspective view of an independent dual electrophotographic copying machine according to the present invention.
Figure 2:
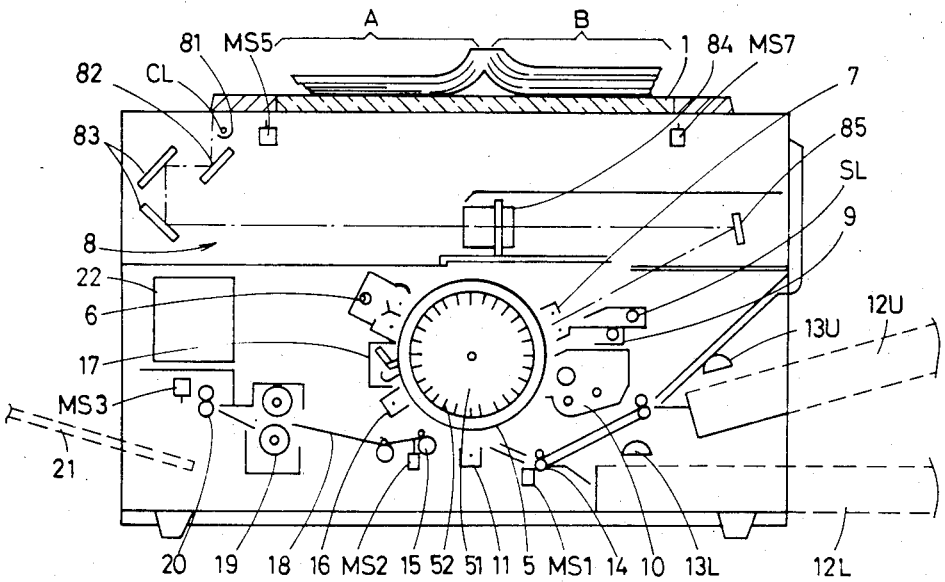
FIG. 2 shows a sectional view of the copying machine of FIG. 1.
Figure 3:
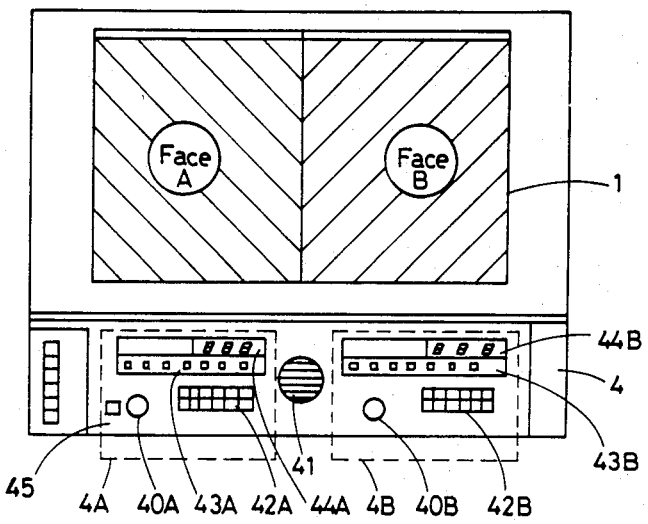
FIG. 3 is a plan view of two manual setting devices directed to two copy documents mounted on two parts of table used for the copying machine.

FIG. 1 is a perspective view of an independent dual electrophotographic copying machine according to the present invention. FIG. 2 is a cross-sectional view of the copying machine. FIG. 3 is a plan view of a control unit in the copying machine.

The word "dual copy" is used herein to indicate that two images of two copy documents mounted on first and second parts of document table are copied on two sheets of copy papers or both major surfaces of a single copy paper. According to the gist of the present invention, in an intelligent dual copy mode, the copy papers, to which the different-size images are copied, have a plurality of different sizes.

Referring to FIG. 1, the copying machine comprises a document table 1 made of a transparent material, a document cover 3 pivotably actuated for covering a document 2 to be copied, and a control unit 4. Copy instructions are inputted into the copying machine by operating the control unit 4. According to the copy instructions to the control unit 4, an electrostatic latent image is formed, corresponding to the document 2 mounted on the document table 1.

It is assumed in the following description that the copying machine can copy the document of an A3 size paper or smaller.

FIG. 2 is a sectional view of the copying machine of FIG. 1, showing the inner construction.

In the copying machine of FIG. 2, a three-layered photoreceptor 5 is disposed around a rotational drum. Preferably, the photoreceptor 5 comprises an electrically conductive base made of A1, a photoconductive layer made of CdS thereon, and an insulative layer made of MYLAR thereon. An example of such a three-layered element and an electrophotographic process therewith is disclosed in H. TANAKA et al, U.S. Pat. No. 3,666,363 issued on May 30, 1972, entitled "ELECTROPHOTOGRAPHIC PROCESS AND APPARATUS". The disclosure of this patent is incorporated herein by reference. The application of the present invention should not be limited to this type of photoreceptor 1.

The peripheral length of the photoreceptor 5 around the drum is assumed to be sufficiently longer than A3 size, called an endless type. A first corona charger (FHV) 6 is provided for initially and uniformly charging the surface of the photoreceptor 5 in a certain polarity. A second charger (SHV) 7 is provided for uniformly charging the photoreceptor 5 to cause an AC corona charge or charge in the opposed polarity by the first charger 6. A light exposing system 8 is provided for emitting light beams toward the document 2 in synchronization with the activation of the second charger 7 and the rotation of the drum carrying the photoreceptor 5. The reflected light beams are incident upon the photoreceptor 5 through the second charger 7 to form an electrostatic latent image. The second charger 7 is provided for passing the reflected light beams toward the photoreceptor 5 and, simultaneously, providing the charge. A magnetic brush type developing device 10 is provided for attaching toner particles onto the electrostatic latent image on the photoreceptor 5 to form a toner image. A charge removing lamp 9 is provided for emitting light beams toward the photoreceptor 5 after the second charger 7 is operated. A transfer discharger (THV) 11 is provided for corona transferring the toner image onto a copy paper. The copy paper is picked up from a number of copy papers as stored within either an upper cassette 12U or a lower cassette 12L. Paper pick-up rollers 13U and 13L are provided for picking up a single copy paper from the papers in the cassettes 12U and 12L. Some paper feeding rollers are provided for feeding the picked-up copy paper into the transfer discharger 11.

A pair of separation rollers 15 are provided for separating the copied paper from the surface of the photoreceptor 5. A charge-removing corona discharger 16 is provided for charging the photoreceptor 5 in a polarity opposed to the polarity of the remaining charges on the photoreceptor 5 to remove the charges from the photoreceptor 5. A cleaning device 17 is provided for removing the remaining toner particles from the surface of the photoreceptor 5 to become ready for the next copying operation.

A PT disc 51 is provided with the photoreceptor 5. The disc 51 is rotated in synchronization with the rotation of the photoreceptor 5. A plurality of slits 52 are formed around the disc 51 to detect the rotational angle of the photoreceptor 5, so that the copying operation is conducted in synchronization with the rotation of the photoreceptor 5. In a preferred form of the present invention, 30 slits 52 are formed with an equal interval therebetween. A detection means 32 (FIG. 4) is provided for detecting the position of each of the slits 52. By detecting slit signals from the slit detection means, every element of the copying machine is controlled to copy.

The copied paper separated by the separation rollers 15 is guided by a guide plate 18 toward a pair of fixing rollers 19. The rollers 19 are provided for processing the toner image onto the copied paper to fix the toner image thereon. A pair of expelling rollers 20 are provided for guiding the fixed paper toward an expelling tray 21 which is positioned to receive an expelled paper from the body of the copying machine.

The optical system 8 includes a light emission device 81 for emitting light beams toward the document table 1, a first mirror 82 for reflecting the reflected light beams from the surface of the document 2, a second pair of mirrors 83 for directing the reflected beams from the first mirror 82 to a light passageway of the lens 84, and a third fixed mirror 85 for reflecting the beams passing along the lens 84 to the photoreceptor 5 through the second charger 7. The first mirror 82 is positioned on a first supporter together with the light emitting device 81. The first supporter is horizontally moved in parallel with the document table 1. The second paired mirrors 82 are disposed on a second supporter relatively connected to the first supporter. The first supporter is horizontally moved in synchronization with the rotation of the photoreceptor 5 and at the same speed as the rotational speed of the same. in unison with the movement of the first supporter, the second supporter is horizontally moved with half of the speed of the first supporter. Then, the first mirror 82 is horizontally moved in parallel with the document table 1, so that the document 2 is scanned and the reflected light beam images are incident upon the photoreceptor 5 simultaneously with the operation of the second charger 7. A first lamp CL of the light emitting device 81 is switched on simultaneously with the movement start of the first mirror 82 to light the document 2. A second lamp SL is provided for uniformly emitting light beams toward the photoreceptor 5 simultaneously with the operation of the second charger 7. The second lamp SL is positioned adjacent the second charger 7. The second lamp SL is switched off simultaneously with the switching on of the first lamp C while the lamp SL is switched on simultaneously with the switching off of the first lamp CL. That is, the second lamp SL is provided for removing unnecessary charges on the photoreceptor 5 in case the first lamp CL is switched so as not to expose the document 2 to the light beams.

A main motor (MM) 22 is provided for driving the photoreceptor 5, the first mirror 82, the pick-up rollers 13, the feed rollers 14, and the fixing rollers 19 etc. The rotation of the main motor 22 directly enables the driving of each of the photoreceptor 5, the fixing rollers 19, the expelling rollers 20, and the separation rollers 15 etc. The first supporter having the first mirror 82 is moved along the direction of scanning the document 2 since a mirror feed clutch (MFC) is energized. It is returned at the initial position by energizing a mirror return clutch (MRC). At the same time, the second supporter of the second paired mirrors 83 is moved in the same direction. The pick-up rollers 13 are rotated by energizing a paper feed solenoid (PFS). The feed rollers 14 are rotated by energizing a paper start solenoid (PSS).

Figure 4:
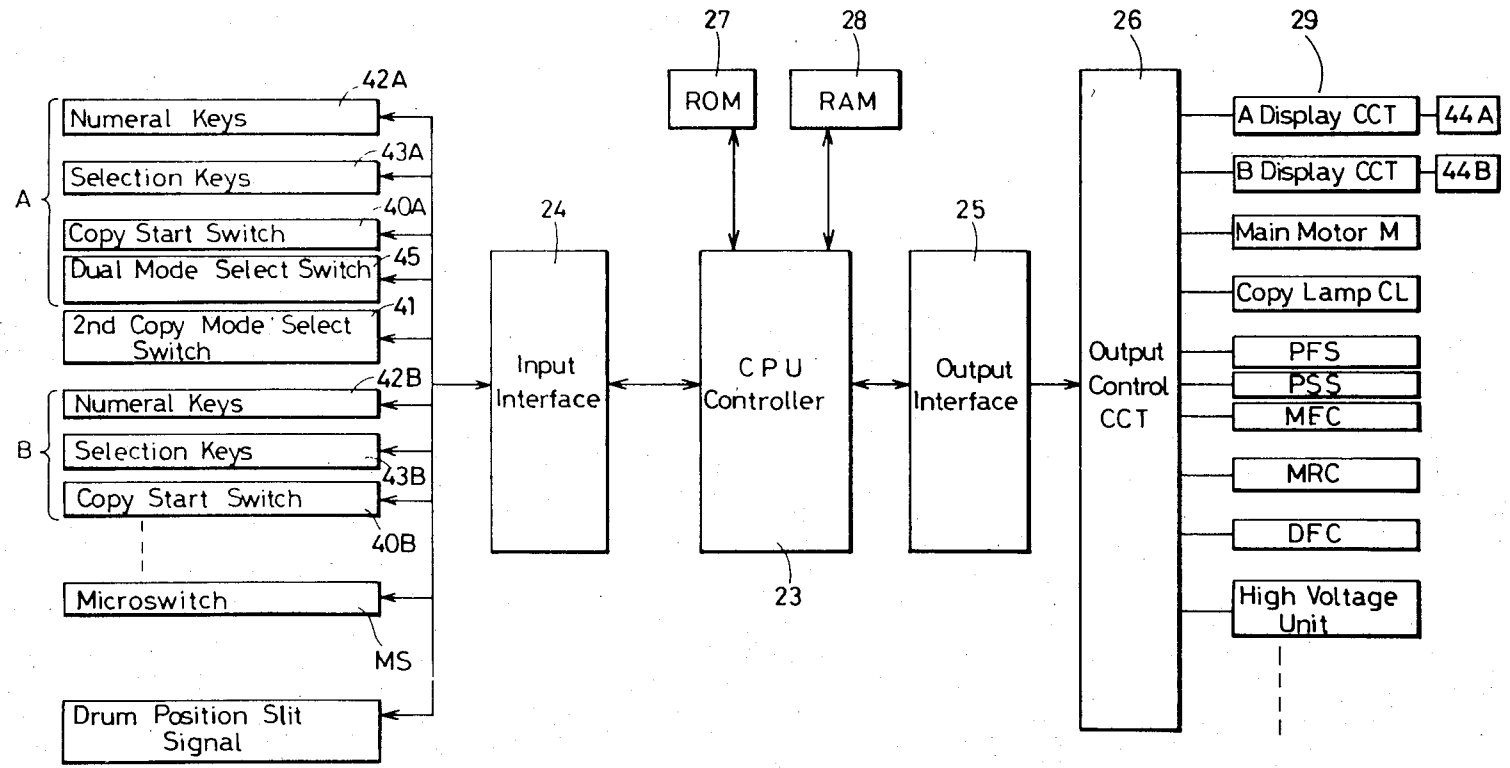
FIG. 4 is a block diagram of a control circuit implemented within the copying machine of FIG. 1.

FIG. 4 is a block diagram of a control circuit for the copying machine. The control circuit is operated to activate the main motor 22, the clutches, and the solenoids.

With reference to FIG. 4, a central processing unit (CPU) controller 23 is provided for storing the control program executing the normal copying operation, a simple dual copying operation, and an intelligent dual copying of the present invention.

The simple dual copying operation mode occurs when two documents mounted on first and second parts of the document table 1 are copied on the identical size copy papers from the same paper cassette 12U or 12L, for the same number of copies. The intelligent dual copy operation mode occurs when a different number of copies and a different copy size can be selected in copying the two documents on the first and second parts of the document table 1. This intelligent dual copying operation mode is refererd to as "the second dual copying operation mode" herein.

A simple dual mode switch 45 or a second dual mode switch 41 is operated to select the simple dual copy mode and the second dual mode, respectively. The ROM 27 is responsive to the mode switches 41 and 45 for developing the corresponding program to enable the respective copying programs. If neither of the mode switches 41 or 45 are operated, the normal copy mode is automatically selected. In this case, the CPU controller 23 enables the normal copying operation in response to the actuation of the copy start switch 40A.

The CPU controller 23 communicates with the various key switches on the control panel 4 via an input interface 24. In response to instructions from the key switches, CPU controller 23 provides control signals to an output control circuit 26 via an output interface 25 in order to control various controlled elements 29 in accordance with the signals from the plurality of micro-switches MS and the photoreceptor-position detection signals (slit pulse signals). As stated above, the micro-switches MS are provided for detecting the movement conditions of the copy paper. The CPU controller 23 is responsive to the copy instructins for enabling copying operations based on the control programs stored in the ROM 27. Further, the CPU controller 23 enables a random access memory (RAM) to store the necessary information to execute the programs.

FIG. 3 is a plan view of the key switches disposed on the control panel 4. The control panel 4 comprises a first control unit 4A and a second control unit 4B. The full size of the copy mount area on the document table 1 is divided in half as face A and face B. The first control unit 4A is operated to instruct copy information for a document mounted on face A while the second control unit 4B is operated to instruct copy information for a copy document mounted on face B. The second dual mode switch 41 is operated to select the second dual mode according to the gist of the present invention. Each of the control units 4A and 4B contain a copy or print start switch 40A or 40B, a numeral keyboard 42A or 42B actuated to set the copy number to be copied, a selection keyboard 43A or 43B actuated to set the copy size and the copy zooming degree, and a copy display 44A or 44B for displaying the number of copied papers etc. In the control unit 4A, the simple dual mode selection key switch 45 is provided for selecting the simple dual mode.

Referring to FIG. 4, as stated above, to the CPU controller 23, the instructions are inputted from the control panel 4 and the detection signals from the respective micro-switches MS for detecting the copy conditions. Based on these signals, the CPU controller 23 generates control signals IC to the output control circuit 26 to operate the controlled elements 29 containing the main motor 22, the clutches etc. The micro-switches MS are positioned within the inner side of the copying machine as shown in FIG. 2 in order to detect the copy conditions.

More particularly, a first micro-switch MS1 is provided for detecting whether the copy paper is positioned adjacent the feed rollers 14. A second micro-switch MS2 is provided for detecting whether the copied paper is separated from the photoreceptor 5 by the separation rollers 15. A third micro-switch MS3 is provided for detecting whether the copied paper is expelled by the expelling rollers 20. A fifth micro-switch MS5 is provided for detecting whether the first mirror 82 is positioned at the scanning start point. A seventh micro-switch MS7 is provided for detecting whether the first mirror 82 is overrun at the document scanning point.

To the CPU controller 23, the copy paper size signals are inputted. These signals are to detect the copy paper size of the cassette 12U or 12L now coupled to the copying machine. A paper size identifier is provided on the cassette 12U or 12L. The identifier is four code units formed at the front side of the cassette 12U or 12L depending on the kind of size of the papers to be stored in the cassette 12U or 12L. When the cassette 12U or 12L is mechanically coupled to the copying machine, the specific code units are also mechanically coupled to switches on the copying machine, each of these switches detecting the presence of the code units. The switches are positioned to face the code units, respectively. Each of the switches is switched ON and OFF by each of the code units.

As described above, the paper size detection signals of the paper size detection means are inputted into the CPU controller 23 to switch ON/OFF the related lamps of the size display. As FIG. 1 shows, the cassettes 12U and 12L are inserted into two stories, it is necessary to select one of the cassettes to be used. By detecting whether the signals of the paper size selection key switches 43A or 43B, and those of the cassette 12U or 12L agree, the selected paper size lamps are switched ON in accordance with the agreement detection. Then, the CPU controller 23 causes the pick-up roller 13U or 13L to be rotated, the pick-up roller 13U or 13L for the cassette 12U or 12L having papers whose size is selected.

Figure 5:
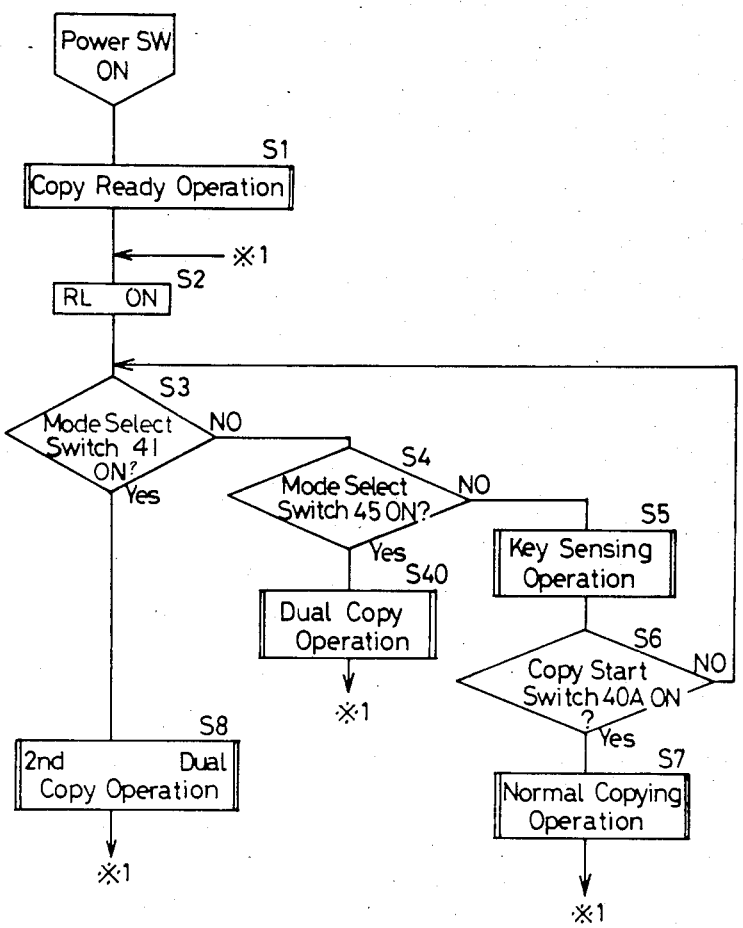
FIGS. 5, 6, and 7 are flow charts of the copying operation to the present invention.

FIG. 5 is a flow chart of the operation of the CPU controller 23 of FIG. 4.

1. Normal Copy Mode:

In this case, the second dual mode switch 41 is not operated. In the control unit 4A, the copy paper size and the copy number information are inputted. Thereafter, the copy start switch 40A is actuated to perform the copy operation according to the inputted copy paper size and the copy number.

When the power-on switch of the control unit 4 is switched ON, the initial signal IR is generaged to initialize the CPU controller 23.

Step S1: The fixing rollers 19 are heated until reaching the toner fixable temperature.

Step S2: The copy ready lamp RL is illiminated to advise the operator of the copy ready condition. During this time, the copying machine is placed in the normal copy condition.

Step S5: The respective key switches 42A and 42B of the control panel 40A are operated to input the copy information, so that the RAM 28 stores the inputted copy information in the corresponding locations.

In the normal copy mode, the mode selection switches 41 and 45 are not operated to thereby select steps S3-S4-S5 in which the key input conditions of the control unit 4A are detected. For this purpose, the CPU controller 23 provides key strobe signals (timesharing signals) to each of the control units 42A and 43A, to thereby detect and input the key input information. In response to the key input information, the corresponding copy information is stored in the predetermined locations of the RAM 28. If no further key input operation is conducted, step S6 is selected. When A4 size copy paper and two copies are selected, the display 44A displays "2". The paper pick up roller 13 relating to A4 size cassette is selected and operated.

Step S6: It is detected whether the copy start switch 40 is activated. If it is not operated, the steps S3-S4-S5 are repeated.

Figure 8:
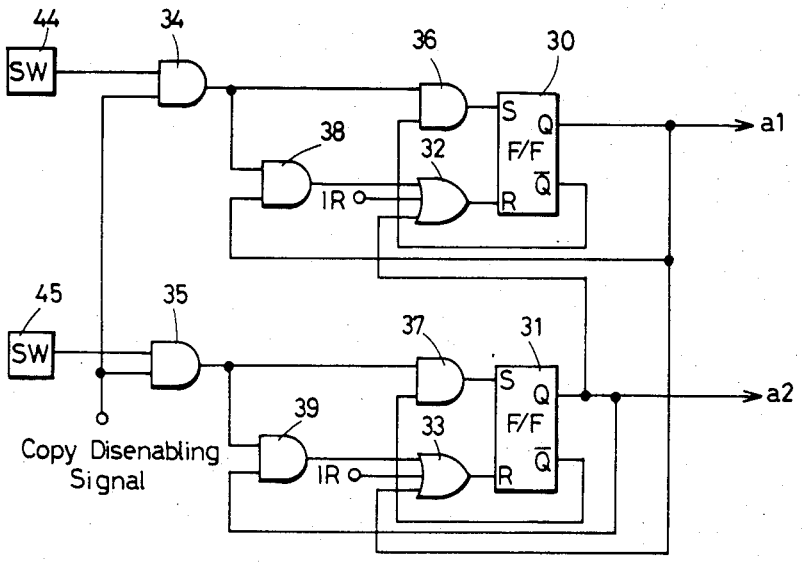
FIG. 8 is a block diagram of a mode selection circuit in the control circuit according to the present invention.

Detecting the key input information in step S5 is that the key inputs to the key switches on the control panel 4 are detected and the input information is stored into the predetermined locations of the RAM 28. In such a case, if either of the mode selection key switches 41 and 45 is operated, the corresponding mode is selected. For example, in the key sensing operation of step S5, the operation of the mode selection switch 41 enables the selection of the second dual copy mode, so that steps S3 to S8 in FIG. 5 proceed to execute the second dual copy mode. If during the dual copy mode, the mode selection switch 41 is operated again, the normal copy mode is returned. FIG. 8 is a block diagram for operating such a control.

With reference to FIG. 8, flip-flops 30 and 31 are provided for storing the conditions of the second dual copy mode and the simple dual copy mode, respectively. When signals a1 and a2 of the set output Q are in a high level "H", each of the modes is selected to be inputted into the CPU controller 23. Upon power application, the initial signal IR is inputted into reset terminals of the flipflops 30 and 31 via OR gates 32 and 33, to reset the flip-flops 30 and 31. Upon power application, the output signals a1 and a2 are in a low level "L", so that the normal copy mode is automatically selected. When the mode selection switch 41 is turned ON, the corresponding signal is inputted into an input terminal of an AND gate 36 via an AND gate 34. The AND gate 34 is placed in the operative condition in response to a signal generated when the copying machine is inoperative. When the copying machine is awaiting copy start, the operation of the mode selection switch 41 or 45 is effective. The reset output $\overline{Q}$ of the flip-flop 30 or 31 is applied to the other input terminal of the AND gate 36 or 37. Therefore, in the normal copy mode, the two flip-flops 30 and 31 are reset, so that the AND gate 36 is operative. When the mode selection switch 40 is turned ON, the flip-flop 30 is set. The set signal a1 of flip-flop 30 is applied into the CPU controller 23 to thereby select the second dual copy mode. The controller 23 operates such a program. During the second dual copy mode, the mode selection switch 45 is turned ON, so that the flip-flop 31 is set because the AND gates 35 and 37 are placed in an operative condition. Therefore, the set output a2 of the flip-flop 31 is applied to the controller 23 to select the simple dual copy mode. At this time, the set output of flip-flop 31 is applied to the set terminal of the flip-flop 30 via the OR gate 32, so that the second dual copy mode is released.

During the simple dual copy mode or the second dual copy mode, the ON operation of the mode selection switch 45 or 41 enables the AND gates 38 or 39 to be conductive, so that the reset signal is inputted into the flip-flops 30 and 31 via the OR gates 32 and 33. Hence, the two dual copy modes are released to be returned to the normal copy mode.

Although not shown in FIG. 8, a two-minute timer is provided for generating a two-minute counting signal into the OR gates 32 and 33. The signal is provided so that the normal copy mode is automatically returned to when in the simple dual copy mode or the second dual copy mode, any copy instruction (for example, the actuation of the copy start switches 40A and 40B) is not started within 2 minutes.

Referring now to FIG. 5, as described above, the copying machine is placed in a copy ready condition upon power application. In the normal copy mode, the copy start switch 40A is actuated to thereby select step S7 in which a copy operation is executed on a selected copy size. After the completion of the copy operation, the copy ready lamp is illuminated in step S2 to indicate the possibility of the next copy operation.

2. Simple Dual Copy Mode:

To start the simple dual copy mode, each copy document is disposed onto the faces A and B of the document table 1 as shown in FIG. 3. The simple dual mode selection switch 45 is operated so that the simple dual copy mode is conducted according to the inputted copy information.

Figure 6:
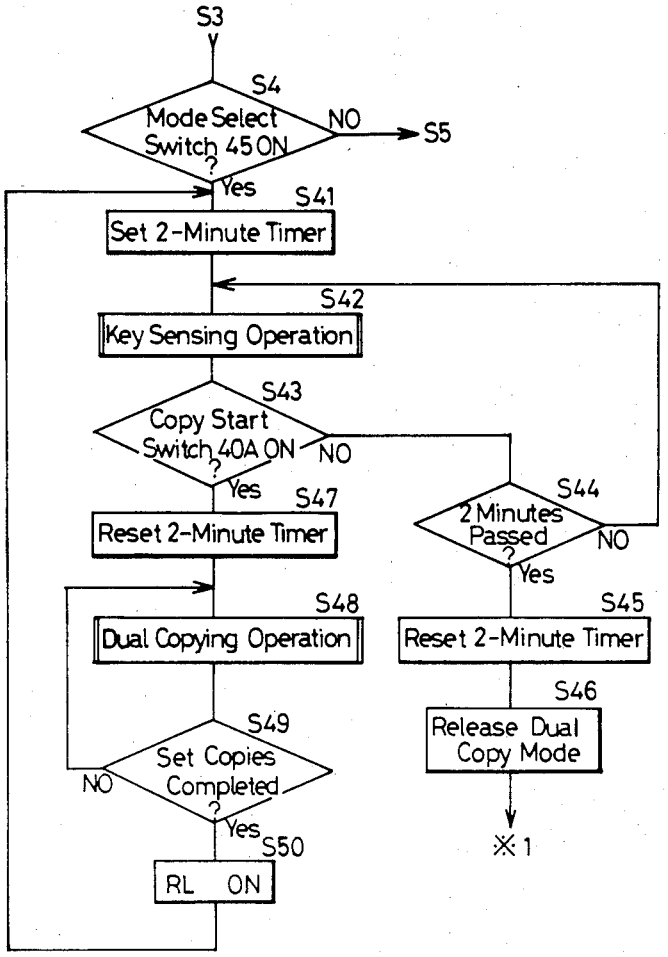

Step S40: This step is selected when the simple dual mode selection switch 45 is actuated in step S4 to execute the simple dual copy mode. FIG. 6 is a flow chart of the simple dual copy mode.

Step 41 of FIG. 6: The two-minute timer is set. This timer is placed in the condition for the simple dual copy mode in response to the operation of the simple dual mode selection switch 45. If no copy operation is started within 2 minutes, the normal copy mode, which is more frequently used, is automatically returned to.

Step S42: The key sensing operation similar to the operation of step S5 are performed. The copy information with the control unit 4A is detected to thereby input the inputted information into the RAM 28. It can be constructed so that any operation of the other control unit 4B is neglected during this time.

Step S43: It is detected whether the copy start switch 40A is actuated.

Step S44: If the switch 40A is not operated in step S43, step S44 is selected so that it is detected whether the two-minute timer has counted 2 minutes or not.

Steps S42-S43: These steps are selected if it is detected that 2 minutes have not passed since the operation of the simple dual mode selection switch 45. In step S43, the operation of the copy start switch 40A is detected.

Step S45: If the copy start switch 40A is not operated within 2 minutes in the simple dual copy mode, the two-minute timer is reset after 2 minutes.

Step S46: The dual copy mode is released, so that the normal copy mode is automatically returned.

Step S47: If the copy start switch 40A is operated within 2 minutes, the two-minute timer is reset in step S47, whereby the simple dual copy mode is executed.

Step S48: The copy document mounted on the face A is copied. After this copy, the copy document mounted on the face B is copied.

Step S49: It is detected whether the copy operation has been completed. A selected number of copies have been made or not. If not, step S48 is repeated until the selected number of copies have been made.

Step S50: The copy ready lamp is switched ON. Step S41: This step is reselected to set the two-minute timer. The next start of the simple dual copy mode is awaited.

3. Second Dual Copy Mode:

During the simple dual copy mode, once the mode selection switch 45 is operated, it is detected in step S42, so that the simple dual copy mode is released to select the second dual copy mode. Steps S3-S8 are selected to execute the second dual copy mode according to the feature of the present invention.

As described earlier, when the second dual mode selection switch 41 is operated prior to the start of the copy operation, the second dual copy mode is selected.

Figure 7:
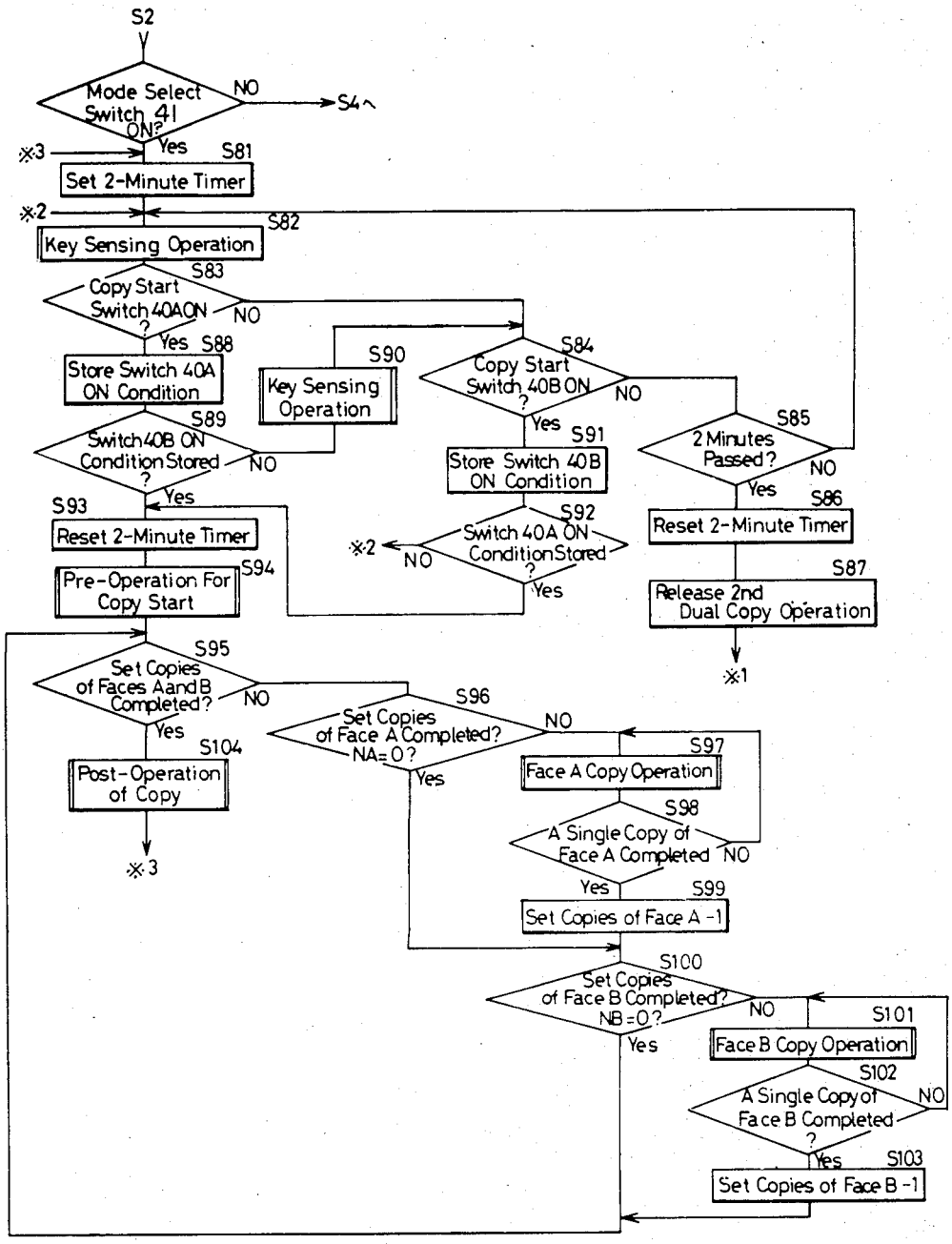

FIG. 7 is a flow chart of the second dual copy mode.

With reference to FIG. 7, the detection of step S3 of FIG. 5 advances the program to step S8 in which the second dual copy mode is performed.

Step S81: Ater the second dual copy mode has been selected, the two-minute timer is set to automatically return to the normal copy mode if the copy operation is started within 2 minutes of the second dual copy mode as similar to the case of the simple dual copy mode.

Step S82: The key sensing operation is enabled to detect the copy input information of the control units 4A and 4B relating to the faces A and B. The inputted information is stored into the RAM 28.

Step S83: It is detected whether the copy start switch 40A is operated or not.

Step S84: If the copy start switch 40A is operated, this step is selected in which the copy start switch 40B in the control unit 40B is detected.

Step S85: If it is detected in step S84 that the copy start switch 40B is not operated, this step is selected to pass the set time in the two-minute timer.

Steps S82-S83-S84-S85-S82: It is detected whether the copy start switches 40A and 40B are operated.

Steps S-85-S86-S87: These steps are passed when neither of the copy start switches 40A or 40B are operated within 2 minutes. The two-minute timer is reset and the second dual copy mode is released to thereby automatically return to the normal copy mode.

It is assumed that in the second dual copy mode, after the input of the copy information, the copy start switch 40A relating to the face A is first operated and then the copy start switch 40B relating to the face B is operated. Further, the copy document to be mounted on the face A is B5 and the number of copies is 2. Besides, the copy document to be mounted on the face B is A4 and the number of copies is 3.

For this assumption, the B5 size copy papers are selected by operating the selection keyboard 43A. The A4 size copy papers are selected by operating the selection keyboard 43B. The information for the copy papers are stored in the RAM 28. Based on the control, the display 44A for the face A displays "2" while the display 44B for the face B displays "3". Such a display can be enabled according to the control of step S82. Thereafter, the detection of the operation of the copy start switches 40A and 40B is conducted.

Steps S83-S88: The operation of the copy start switch 40A selects these steps. The RAM 28 stores the condition that the copy start switch 40A has been operated.

Step S89: It is detected whether the RAM 28 can store the condition that the copy start switch 40B of the control unit 4B for the face B is operated.

Step S90: At this time, the copy start switch 40B has not been actuated and the RAM 28 cannot store the condition. Step S90 is selected to sense the key input information. This step is simliar to step S82. Here, while the copy start switch 40A is operated by an operator, an additional copy operation using the face B is possible by the same operator or a different operator by inputting the copy information using the control unit 4B. The key input information from the control unit 4B is detected in step S90.

Step S84: It is detected whether the copy start switch 40B is operated.

Step S91: When the operation of the copy start switch 40B is detected, this step S91 is selected so that the RAM 28 stores the condition that the copy start switch 40B has been operated.

Step S92: It is detected whether the RAM 28 stores the condition that the copy start switch 40A of the control unit 4A has been operated.

Steps S92-S93: Since the copy start switch 40A has been operated, step S92 is advanced to step S93 in which the two copy operations for the respective copy faces are enabled according to the set copy information.

Steps S92-S82-S83: These steps are selected if the copy start switch 40B for the face B is first operated to check the operation of the copy start switch 40A for the face A.

As described above, after the input of the copy information for the respective copy faces, the copy start switches 40a and 40B are operated.

Step S93: The two-minute timer is reset.

Step S94: The pre-copy operations are conducted prior to the start of the copy operation.

Steps S95-S96-S97: The copy document mounted on the face A is copied. The selected B5 size copy papers are automatically supplied to receive the copy image.

Step S98: It is detected whether a single copy of the copy document mounted on the face A has been completed. If not, the operation of step S97 for the document on the face A is conducted.

Step S99: The total copy number (NA) of the document on the face A is counted down by 1.

Steps S100-S101-S102: A single copy for the document on the face B is prepared. The A4 size copy papers are automatically supplied because the cassette storing the papers is selected. The copy image of the document for the face B is obtained on the copy paper.

Step S103: After the completion of the single copy of the document on the face B, this step is selected to count down the total copy number (NB) of the document on the face B by 1. Thereafer, step S95 is returned.

Step S95: It is detected whether all of the copies have been completed for the faces A and B, namely, the countdown of the total numbers NA and NB is zero or not.

Step S96: If all the copies have not been finished, step S96 is selected to check the copy number for the document on the face A. If "NA 0" is not detected, the above copy operations are repeated.

Step S100: The copy number of the document on the face B is checked. If "NA=0" is not detected, the copy operation for the document on the face B is repeated.

Steps S95-S96-S100: When 2 copies for the document on the faces A and B have been finished, "NA=0" is obtained, but "NB=1" is obtained to thereby select these steps in which a single remaining copy for the document on the face B is prepared. Now, "NB=0" is given.

Steps S95-S104: Step S95 is passed and step S104 is selected to conduct the postcopy operation. In the postcopy operation, the remaining toners and charges are removed from the photoreceptor, so that the photoreceptor is initialized for the next copy operation. Thereafter, the copy ready lamp is illuminated.

Step S81 is returned.

As described above, according to the present invention, the full size of the document table is divided in half as the faces A and B. The documents on the faces A and B are independently copied based on the input of the different copy information. The size of both of the faces A and B is equal to or smaller than the half size of the full size of the document table 1.

During the second dual copy mode, the second dual mode selection switch 41 is operated except for the time during an actual copy operation to return to the normal copy mode. The operation of the simple dual mode selection switch 45 enables the selection of the simple dual copy mode. This is because in step S82 and the like, the key input information is detected and the operation of the mode selection switches 41 and 45 is detected. Based on the detection signals, steps S40 and S47 are selected.

Further, according to the present invention, the second dual mode selection switch 41 actuated to select the second dual mode is provided on the control panel 4. It may be possible that the control unit 4B used only for inputting the copy information of the document of the face B is invisible from the control panel 4 during the normal copy mode and the simple dual copy mode. For example, the control unit 4B is stored within a cover means. The opening and closing of the cover means can be synchronized with the selection of the normal copy mode and the simple dual copy mode. The opening of the cover means to expose the control unit 4B outside enables the second dual copy mode to be automatically selected. The closing of the cover means enables the selection of the just previously selected copy mode. For this purpose, a switch is provided for detecting the opening and closing of the cover means. In response to the detection of this switch, the simple dual copy mode and the normal copy mode can be selected. This arrangement provides that in the normal copy mode and the simple dual copy mode, the control unit 4A is only visible and effective to simplify the input operation. When the control unit 4B is exposed outside, the different input information can be inputted into the control units 4A and 4B for the second dual copy mode.

Further, in the present invention, in the normal copy mode, the operation of the copy start switch 40A of the control unit 4A is checked in steps S43 and S6. It may be possible that the copy operation is started in response to the operation of either the copy start switches 40A or 40B.In such a case, the copy operation can be conducted based on the copy information from the control unit 4A. Otherwise, the copy information to be conducted is selected from the control unit 4A or 4B containing the actuated copy start switch of either the copy start switch 40A or 40B.

While only certain embodiments of the present invention have been described, it will be apparent to those skiled in the art that various changes and modifications may be made therein without departing from the spirit and scope of the present invention as claimed.

What is claimed is:

1. A control system in a dual electrophotographic copying machine, comprising:

document table means for receiving one or more copy documents positioned to correspond to first and second halves of a total area of said document table means;

copy start means for initiating a copying operation of a copy document disposed on said document table means;

mode selection means for selecting either a simple dual copying operation mode or a second dual copying operation mode, said simple dual copying operation mode being for copying said one or more copy documents positioned on first and second halves of said document table means onto one or both sides of identical size copy papers from a single paper cassette for a same number of copies for each document table half, and said second dual copying operation mode being for copying said one or more copy documents positioned on first and second halves of said document table means onto two different-size copy papers selected from two different paper cassettes for a same or different number of copies;

automatic mode selection means for automatically selecting a normal copying operation mode in the absence of an actuation of said copy start means in either of said simple or second dual-copying operation modes;

selection means, responsive to said mode selection means, for selecting and inputting copy information associated with said first and second halves of said document table means;

detection means, responsive to said selection means, for detecting which of said input copy information relates to either of said first or second halves of said document table means; and control means, responsive to said detection means, for executing a selected copying operation mode upon actuation of said copy start means.

2. The system of claim 1, wherein said detection means includes flip-flop means for storing operation conditions of said simple and second dual copying operation modes.

3. The system of claim 1, further comprising timer means for counting a predetermined length of time after actuation of said copy start means.

4. The system of claim 1, wherein said mode selection means includes first and second selection keyboards corresponding to each of said first and second halves of said document table means, respectively.

5. The system of claim 4, wherein said first selection keyboard includes a dual-mode selection switch for enabling said copying machine to copy both sides of a single copy paper in said simple dual-copying operation modes.

6. The system of claim 1, wherein said automatic mode selection means selects a normal copying operation mode if said copy start means is not actuated within a predetermined length of time after selection of either of said simple or second dual copying operation modes.

7. The system of claim 1, wherein said copy start means is a first finger-actuated button for initiating a copying operation in said simple dual-copying operation mode upon selection thereof, is a second finger-actuated button for initiating a copying operation in said second dual-copying operation mode upon selection thereof, and is said first finger-actuated button for initiating a copying operation in said normal copying operation mode which may be actuated in the absence of selection of either of said simple or second dual-copying operation modes.

* * * * *